US010926560B2

(12) United States Patent
Asamoto

(10) Patent No.: US 10,926,560 B2
(45) Date of Patent: Feb. 23, 2021

(54) PRINTING APPARATUS

(71) Applicant: SEIKO EPSON CORPORATION, Tokyo (JP)

(72) Inventor: Katsuya Asamoto, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/285,853

(22) Filed: Feb. 26, 2019

(65) Prior Publication Data

US 2019/0263158 A1 Aug. 29, 2019

(30) Foreign Application Priority Data

Feb. 27, 2018 (JP) ..... JP2018-033576

(51) Int. Cl.
*B41J 11/00* (2006.01)
*B41J 29/377* (2006.01)
*B41J 29/13* (2006.01)

(52) U.S. Cl.
CPC ..... *B41J 29/377* (2013.01); *B41J 11/00* (2013.01); *B41J 29/13* (2013.01)

(58) Field of Classification Search
CPC ..... B41J 11/0015; B41J 11/002; B41J 29/377
See application file for complete search history.

(56) References Cited

U.S. PATENT DOCUMENTS 6,281,910 B1 * 8/2001 Nakano ..... B41J 29/377 347/34
2017/0072708 A1 3/2017 Miyashita et al.

FOREIGN PATENT DOCUMENTS

JP 2015-217544 A 12/2015
JP 2017-128060 A 7/2017

* cited by examiner

*Primary Examiner* — Jason S Uhlenhake
(74) *Attorney, Agent, or Firm* — Chip Law Group

(57) ABSTRACT

A printing apparatus includes: a printing unit configured to perform printing on a medium; a flow path including a blowout port and an intake port, the blowout port being configured to send gas toward the medium from an upper side of the printing unit in a vertical direction, the intake port being configured to take in outside air; a blower unit arranged in the flow path and configured to generate a gas flow passing from the intake port toward the blowout port; and a housing configured to contain the printing unit and the blower unit and form the flow path. The flow path includes a vertical portion between the intake port and the blower unit where the gas flows in a direction against the gravity.

6 Claims, 2 Drawing Sheets

PRINTING APPARATUS

BACKGROUND

1. Technical Field

The present invention relates to a printing apparatus.

2. Related Art

JP-A-2017-128060 discloses a printing apparatus including a printing unit for performing printing on a medium, a blower unit for sending gas onto the medium, and a housing for storing the printing unit. The printing unit performs printing on the medium by causing liquid to adhere to the medium. The blower unit promotes drying of the medium by sending gas onto the medium. Further, the printing apparatus disclosed in JP-A-2017-128060 includes a gas sending/sucking mechanism. The gas sending/sucking mechanism causes the gas to circulate by sucking the gas inside the housing and returning the sucked gas to the inside of the housing.

As described in JP-A-2017-128060, when the gas inside the housing is caused to circulate, humidity of the circulating gas is increased due to evaporation of the liquid adhering to the medium. When the humidity of the gas increases, degradation of drying efficiency of the medium is caused.

SUMMARY

An advantage of some aspects of the invention is to provide a printing apparatus, which is capable of preventing foreign matters to adhere to a medium and preventing humidity of gas for drying the medium to be increased.

Hereinafter, measures for achieving the above-described object and advantages of the measures will be described.

In order to achieve the above-mentioned object, a printing apparatus includes a printing unit configured to perform printing on a medium, a flow path including a blowout port and an intake port, the blowout port being configured to send gas toward the medium from an upper side of the printing unit in a vertical direction, the intake port being configured to take in outside air, a blower unit arranged in the flow path and configured to generate a gas flow passing from the intake port toward the blowout port, and a housing configured to contain the printing unit and the blower unit and form the flow path, wherein the flow path includes an upward flow path portion between the intake port and the blower unit where the gas flows in a direction against the gravity.

With this configuration, the gas taken into the flow path through the intake port is the outside air. Thus, as compared to the case where the gas is circulated in the housing to dry the medium, humidity of the gas for drying the medium can be prevented from increasing. Further, the flow path includes the upward flow path portion between the intake port and the blower unit. In the upward flow path portion, the gas flows in the direction against the gravity. In a case where the foreign matters are taken into the upward flow path portion through the intake port together with the gas, a force toward the lower side acts on the foreign matters due to the self-weight. Thus, the foreign matters are less liable to move upward in the upward flow path portion, and are prevented from passing through the upward flow path portion and flowing toward the downstream side of the flow path. Therefore, the foreign matters are less liable to be mixed in the gas sent through the blowout port, and the foreign matters can be prevented from adhering to the medium.

In the above-mentioned printing apparatus, it is preferred that the intake port is positioned on a lower side of the blower unit in the vertical direction and that the upward flow path portion extends in the vertical direction between the intake port and the blower unit.

With this configuration, the upward flow path portion has a configuration in which the gas flows upward in the vertical direction. Thus, for example, as compared to the configuration in which the gas flows obliquely upward, the foreign matters are less liable to flow to the downstream side together with the gas flow.

In the above-mentioned printing apparatus, it is preferred that the flow path includes a bent portion between the intake port and the blower unit.

With this configuration, the flow path can be bent by the bent portion. Thus, the degree of freedom in the shape of the flow path can be improved.

In the above-mentioned printing apparatus, it is preferred that the housing defines a space communicating with the bent portion, and the space is positioned on a lower side of the intake port in the vertical direction.

With this configuration, the gas flow does not easily act on the foreign matters accumulated in the space. Thus, the foreign matters having fallen in the space due to the self-weight can be accumulated in the space.

In the above-mentioned printing apparatus, it is preferred that the housing includes an opening communicating to the space, and includes a cover for covering the opening in a closable and openable manner.

With this configuration, by opening the cover, the foreign matters can be removed from the space through the opening. Thus, the foreign matters are easily removed from the space.

BRIEF DESCRIPTION OF THE DRAWINGS

The invention will be described with reference to the accompanying drawings, wherein like numbers reference like elements.

DESCRIPTION OF EXEMPLARY EMBODIMENTS

Now, description is made of an exemplary embodiment of a printing apparatus. Note that, in the following description, "upper" indicates an upper side in the vertical direction, and "lower" indicates a lower side in the vertical direction.

Figure 1:
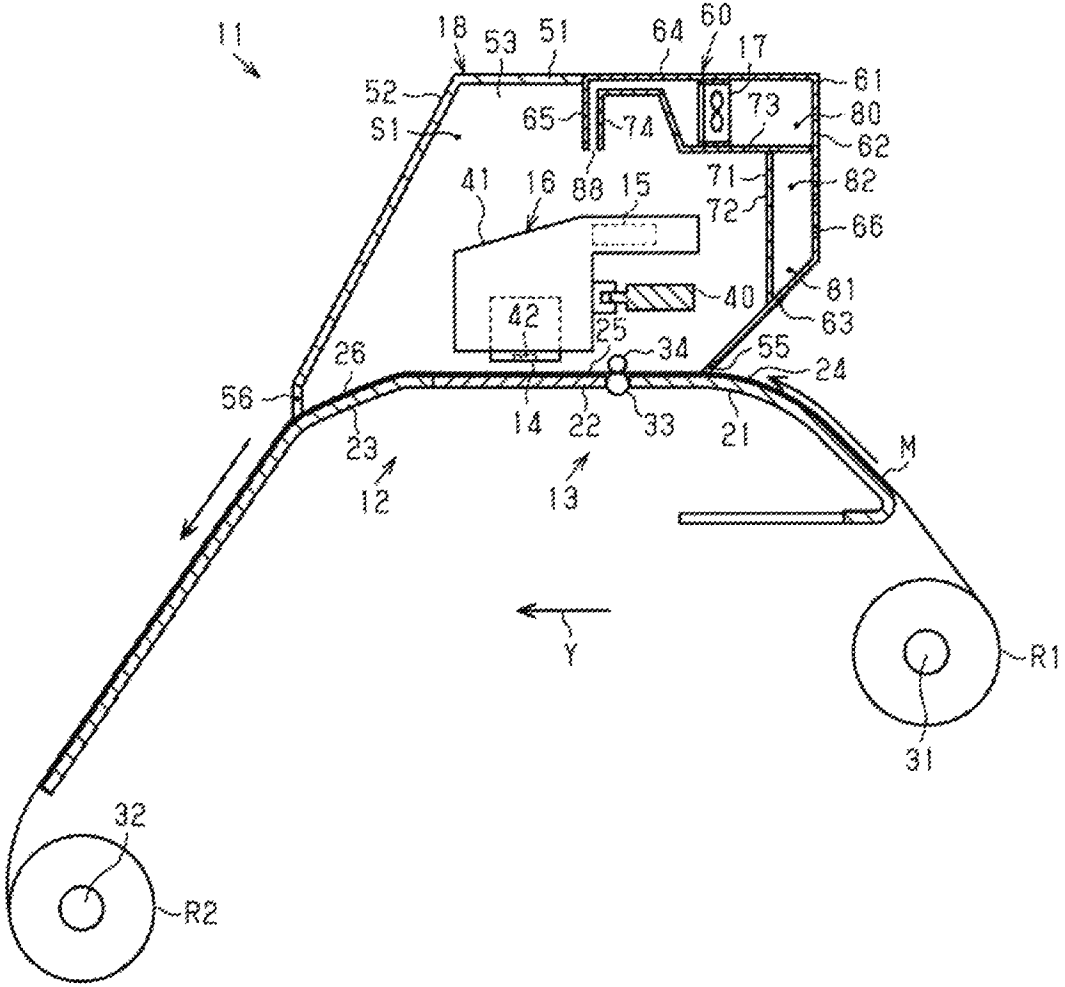
FIG. 1 is a cross-sectional view schematically illustrating an exemplary embodiment of a printing apparatus.
Figure 2:
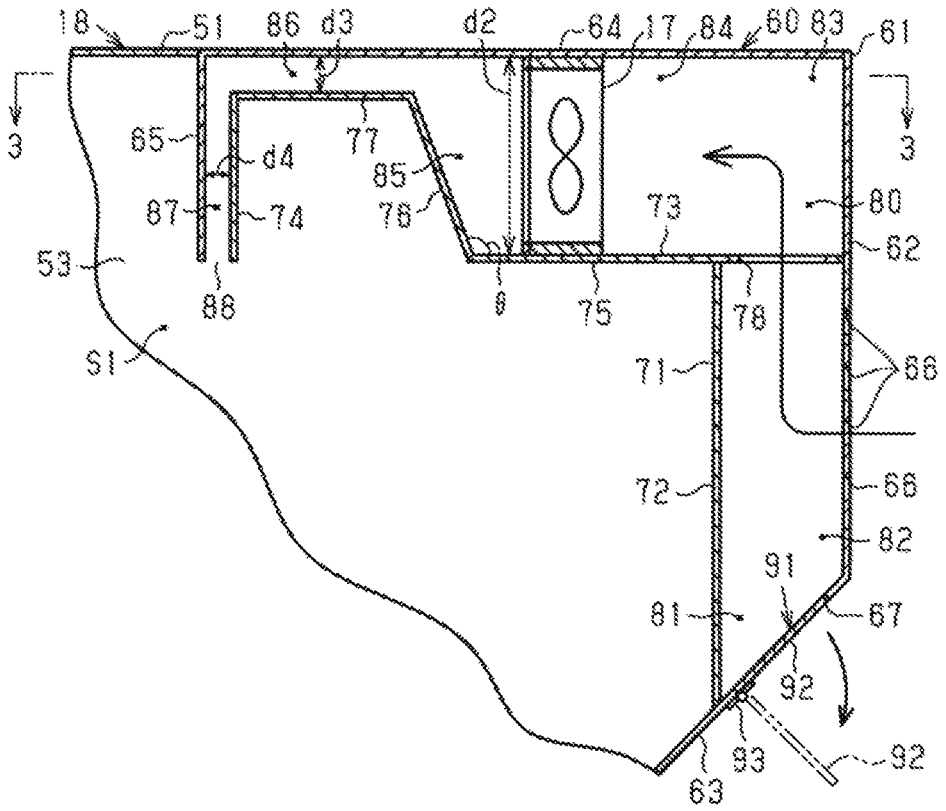
FIG. 2 is a cross-sectional view illustrating a flow-path formation portion in an enlarged manner.

As illustrated in FIG. 1 and FIG. 2, a printing apparatus 11 includes a support unit 12 capable of supporting a medium M, a transport unit 13 configured to transport the medium M along the support unit 12, a printing unit 14 configured to perform printing on the medium M, a drive circuit 15 configured to drive the printing unit 14, a moving mechanism 16 configured to move the printing unit 14, and blower units 17 configured to send gas onto the medium M. The printing apparatus 11 includes a housing 18 configured to contain the printing unit 14, the moving mechanism 16, and the blower units 17. The printing apparatus 11 is, for example, an ink jet-type printer that prints an image such as characters and photographs on the medium M by causing ink being an example of liquid to adhere. The medium M is, for example, a long medium such as continuous sheet.

The support unit 12 includes a first support plate 21, a second support plate 22, and a third support plate 23. The support plates 21, 22, and 23 includes support surfaces 24, 25, and 26, respectively, for supporting the medium M transported by the transport unit 13. The first support plate 21, the second support plate 22, the third support plate 23 are arrayed in the stated order from an upstream side in a transport direction of the medium M. Note that, in the following description, the transport direction of the medium M is referred to as a transport direction Y. Of the support plates 21, 22, and 23, the second support plate 22 is positioned so as to face the printing unit 14.

The transport unit 13 includes a first rotary shaft 31 positioned on the upstream side of the first support plate 21 and a second rotary shaft 32 positioned on the downstream side of the third support plate 23 in the transport direction Y. The first rotary shaft 31 rotatably supports a roll body R1 formed by winding the medium M before printing in a roll shape. The second rotary shaft 32 rotatably supports a roll body R2 formed by winding the medium M after printing in a roll shape. The transport unit 13 includes a transport roller 33 for applying a transport force to the medium M and a driven roller 34 for pressing the medium M against the transport roller 33.

The moving mechanism 16 includes a guide member 40 and a carriage 41 supported by the guide member 40. Of the directions along the support surface 25, the guide member 40 extends in a direction intersecting the transport direction Y.

The printing unit 14 is a head capable of discharging liquid onto the medium M. The printing unit 14 includes nozzles 42 capable of ejecting the liquid. The printing unit 14 is arranged at such a position as to face the medium M. The drive circuit 15 drives the printing unit 14, based on an instruction from a control device (not illustrating). The printing unit 14 and the drive circuit 15 are supported by the carriage 41. The drive circuit 15 is arranged on the upper side of the printing unit 14. The printing unit 14 is capable of discharging the liquid onto the medium M while moving together with the carriage 41.

Figure 3:
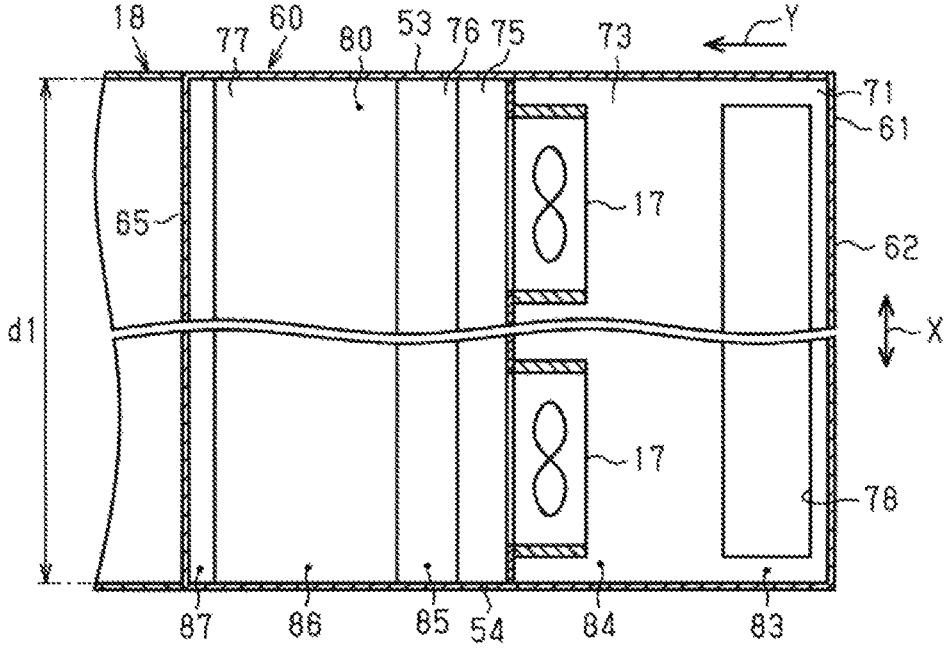
FIG. 3 is a cross-sectional view illustrating the flow-path formation portion taken along the line 3-3 of FIG. 2.

As illustrated in FIG. 1, FIG. 2, and FIG. 3, the housing 18 is arranged on the upper side of the support unit 12. The housing 18 includes a top plate 51, side walls 52, 53, and 54, which extend downward from the top plate 51, and a flow-path formation portion 60. The top plate 51 is arranged to face the support surface 25.

As illustrated in FIG. 1 and FIG. 3, the three side walls 52, 53, and 54 include the two side walls 53 and 54, which face with each other in a scanning direction X being a direction orthogonal to both the vertical direction and the transport direction Y, and the one side wall 52, which extends between the two side walls 53 and 54. Note that, the scanning direction X matches with the moving direction of the carriage 41. In this exemplary embodiment, the two side walls 53 and 54 are provided in parallel to each other. In other words, the two side walls 53 and 54 have a constant separation distance d1 between surfaces facing each other.

As illustrated in FIG. 1, the housing 18 includes a supplying port 55 for communicating an inside and an outside of the housing 18 with each other and a discharging port 56 for communicating the inside and the outside of the housing 18 with each other. The supplying port 55 is provided on the upstream side of the discharging port 56 in the transport direction Y. The medium M transported by the transport unit 13 is supplied to the inside of the housing 18 through the supplying port 55, and is discharged to the outside of the housing 18 through the discharging port 56.

The flow-path formation portion 60 is arranged so as to face the side wall 52. The flow-path formation portion 60 is arranged on the upstream side of the side wall 52 in the transport direction Y. An area surrounded by the top plate 51, the side walls 52, 53, and 54, and the flow-path formation portion 60 is a storage area S1 in which the printing unit 14 and the moving mechanism 16 are stored.

Now, detailed description is made of the flow-path formation portion 60. Note that, in the following description, a direction approaching the side wall 52 from the flow-path formation portion 60 is referred to as "front", and a direction approaching the flow-path formation portion 60 from the side wall 52 is referred to as "rear". Note that, the front side corresponds to the transport direction Y of the medium M transported along the support surface 25. Further, the front-and-rear direction is a horizontal direction orthogonal to the vertical direction.

As illustrated in FIG. 2 and FIG. 3, the flow-path formation portion 60 includes an outer wall 61, an inner wall 71 arranged so as to face the outer wall 61, and an opening/closing portion 91 mounted to the outer wall 61.

The outer wall 61 includes a first outer wall portion 62 extending in the vertical direction, a second outer wall portion 63 joined to a lower end of the first outer wall portion 62, a third outer wall portion 64 joined to an upper end of the first outer wall portion 62, and a fourth outer wall portion 65 joined to a front end of the third outer wall portion 64.

The first outer wall portion 62 includes intake ports 66 passing through the first outer wall portion 62 in a plate thickness direction. In this exemplary embodiment, a plurality of intake ports 66 are provided. The intake ports 66 communicate the inside and the outside of the housing 18 with each other. It can be said that the housing 18 is communicated with the outside of the housing 18, that is, the outside of the printing apparatus 11 through the intake ports 66. The second outer wall portion 63 extends downward from the lower end of the first outer wall portion 62. The second outer wall portion 63 is inclined so that a part of the second outer wall portion 63 is positioned on the front side as approaching the lower side. The second outer wall portion 63 includes an opening 67 passing through the second outer wall portion 63 in the plate thickness direction. The third outer wall portion 64 extends frontward from the upper end of the first outer wall portion 62. The third outer wall portion 64 forms an uppermost part of the housing 18 together with the top plate 51. The fourth outer wall portion 65 extends downward in the housing 18 from the front end of the third outer wall portion 64.

Note that, the first outer wall portion 62, the second outer wall portion 63, the third outer wall portion 64, and the fourth outer wall portion 65 may be a molded article integrally formed of the same member, or may be independent members. That is, the outer wall 61 may be formed of one member, or may be formed by joining a plurality of members.

The inner wall 71 includes a first inner wall portion 72 arranged so as to face the first outer wall portion 62, a second inner wall portion 73 arranged so as to face the third outer wall portion 64, and a third inner wall portion 74 arranged so as to face the fourth outer wall portion 65.

The first inner wall portion 72 is arranged on the front side of the first outer wall portion 62. The first inner wall portion 72 extends between the second outer wall portion 63 and the second inner wall portion 73.

The second inner wall portion 73 includes a first part 75, a second part 76 positioned on the front side of the first part 75, and a third part 77 positioned on the front side of the second part 76. The first part 75 is provided in parallel to the third outer wall portion 64. The first part 75 includes a through hole 78 at a position corresponding to a space between the first outer wall portion 62 and the first inner wall portion 72. The second part 76 is inclined so that a part of the second part 76 is positioned on the upper side as approaching the front side. That is, it can be said that the second part 76 is inclined so that the part of the second part 76 is positioned so as to be closed to the third outer wall portion 64 as approaching the front side. The third part 77 is provided in parallel to the third outer wall portion 64.

A separation distance d3 between the facing surfaces of the third part 77 and the third outer wall portion 64 is smaller than a separation distance d2 between the facing surfaces of the first part 75 and the third outer wall portion 64. An angle θ formed between the first part 75 and the second part 76 is, for example, from 95° to 120°.

The third inner wall portion 74 is provided in parallel to the fourth outer wall portion 65. The third inner wall portion 74 is positioned on the rear side of the fourth outer wall portion 65. A separation distance d4 between the facing surfaces of the third inner wall portion 74 and the fourth outer wall portion 65 is smaller than the separation distance d3 between the facing surfaces of the third part 77 and the third outer wall portion 64. As with the outer wall 61, the inner wall 71 may be formed of one member, or may be formed by joining a plurality of members.

The printing apparatus 11 includes a flow path 80 and a space 81 formed by the flow-path formation portion 60. The flow path 80 includes the intake ports 66, a vertical portion 82 being an example of an upward flow path portion, which extends in the vertical direction, a bent portion 83 for bending the flow path 80, and a first flow-through portion 84 extending frontward from the bent portion 83. Further, the flow path 80 includes a narrowing portion 85 extending frontward from the first flow-through portion 84, a second flow-through portion 86 extending frontward from the narrowing portion 85, a blowout out portion 87 extending downward from the second flow-through portion 86, and a blowout port 88 through which the gas is blown out. Note that, the through hole 78 for communicating the vertical portion 82 and the bent portion 83 with each other is also a part of the flow path 80.

The vertical portion 82 is formed by the first outer wall portion 62, the first inner wall portion 72, the first part 75, and the side walls 53 and 54. The vertical portion 82 is an area positioned on the upstream side of the bent portion 83 in a direction in which the gas flows. The bent portion 83 and the first flow-through portion 84 are formed by the first outer wall portion 62, the third outer wall portion 64, the first part 75, and the side walls 53 and 54. The bent portion 83 is in an area positioned on the upstream side of the first flow-through portion 84 in the direction in which the gas flows, and in an area where the bent portion 83 faces the vertical portion 82 in the vertical direction. In this exemplary embodiment, the first outer wall portion 62 and the third outer wall portion 64 are joined to each other so as to be bent, and hence it can be said that the bent portion 83 is bent. The bent portion 83 may be curved by joining the first outer wall portion 62 and the third outer wall portion 64 to each other to form a curve. The first flow-through portion 84 is in an area positioned on the downstream side of the bent portion 83 in the direction in which the gas flows.

The narrowing portion 85 is defined by the third outer wall portion 64, the second part 76, and the side walls 53 and 54. Here, of the directions intersecting the flow-through direction of the gas flowing through the flow path 80, a dimension of flow path 80 in a direction orthogonal to the direction along the width direction of the medium M (that is, scanning direction X) is regarded as a flow path width. The narrowing portion 85 is a portion having a flow path width that is gradually reduced as approaching the downstream side in the direction in which the gas flows. Note that, the flow path width can be said as the separation distance between the facing surfaces of the outer wall 61 and the inner wall 71.

The second flow-through portion 86 is formed by the third outer wall portion 64, the third part 77, and the side walls 53 and 54. The flow path width of the second flow-through portion 86 is the same as the flow path width of the narrowest part of the narrowing portion 85.

The blowout portion 87 is defined by the fourth outer wall portion 65, the third inner wall portion 74, and the side walls 53 and 54. The flow path width of the blowout portion 87 is smaller than the flow path width of the second flow-through portion 86. Thus, the flow path width becomes narrower in the order of the first flow-through portion 84, the narrowing portion 85, the second flow-through portion 86, and the blowout portion 87.

The blowout port 88 is opened downward. The blowout port 88 is positioned on the upper side of the printing unit 14. The blowout port 88 is positioned so as to face the medium M. That is, the blowout port 88 is provided so that the gas blown out through the blowout port 88 is sent from the upper side of the printing unit 14 toward the medium M. Further, in this exemplary embodiment, the blowout port 88 is provided at such a position as to face the carriage 41.

The space 81 is formed by the second outer wall portion 63, the first inner wall portion 72, and the side walls 53 and 54. The space 81 is formed on the lower side of the bent portion 83 and on the lower side of the vertical portion 82, and is in an area on the lower side of the intake ports 66. The opening 67 of the second outer wall portion 63 communicates to the space 81.

The opening/closing portion 91 includes a cover 92 capable of closing the opening 67, and a hinge 93. The cover 92 turns around the hinge 93 as the turning center to enable opening of the opening 67 and closing of the opening 67. It can be said that the cover 92 covers the opening 67 in a closable and openable manner. Although illustration is omitted, the opening/closing portion 91 includes a fastener. With this fastener, the cover 92 can maintain the opening 67 in the closed state.

The blower units 17 are arranged in the first flow-through portion 84. In this exemplary embodiment, the plurality of blower units 17 are provided at an interval in the scanning direction X. The blower units 17 are driven to generate a gas flow passing from the intake ports 66 toward the blowout port 88. The blower units 17 are, for example, fans.

The blower units 17 are arranged in the first flow-through portion 84, and hence it can be said that the vertical portion 82 and the bent portion 83 are positioned between the intake ports 66 and the blower units 17. Further, the intake ports 66 are positioned on the lower side of the blower units 17.

Next, description is made of effects of the printing apparatus 11 according to this exemplary embodiment.

When printing is performed by the printing apparatus 11, the blower units 17 are driven to cause the gas to flow through the flow path 80. The gas flows through the intake ports 66 into the vertical portion 82, and flows upward in the vertical portion 82. That is, in the vertical portion 82, the direction in which the gas flows in a direction against the gravity. The gas flowing upward in the vertical portion 82 flows through the through hole 78 into the bent portion 83, is changed in the flow-through direction at the bent portion 83, and flows frontward in the first flow-through portion 84, the narrowing portion 85, and the second flow-through portion 86. The gas flowing through the second flow-through portion 86 flows into the blowout portion 87, and flows through the blowout port 88 into the storage area S1.

The intake ports 66 intakes the outside air (outside gas) into the vertical portion 82 from the outside of the housing 18, in other words, the outside of the printing apparatus 11. Thus, the gas blown out through the blowout port 88 is the outside air.

Due to the outside air taken into the flow path 80, foreign matters may be taken into the flow path 80 together with the outside air, depending on a peripheral environment of the printing apparatus 11. The gas flowing through the vertical portion 82 flows in a direction against the gravity, and hence a force toward the upper side acts on the foreign matters taken into the vertical portion 82. Note that, the direction against the gravity includes the vertical direction and a direction inclined with respect to the vertical direction. A force toward the lower side also acts on the foreign matters due to the self-weight. Thus, the foreign matters are less liable to move up the vertical portion 82, and are prevented from reaching the downstream side of the vertical portion 82. That is, the vertical portion 82 functions as a trap utilizing the gravity, and prevents the foreign matters from entering the storage area S1. The foreign matters fall in the space 81 due to the self-weight. The space 81 is provided on the lower side of the intake ports 66, and hence the foreign matters having fallen in the space 81 are prevented from flying up together with the gas flow.

The blower units 17 are arranged at an interval in the scanning direction X. Accordingly, in the first flow-through portion 84, a flow rate is higher at positions facing the blower units 17. When it is assumed that the flow path width on the downstream side of the blower units 17 is constant in the direction in which the gas flows, the flow rate of the gas supplied to the medium M varies, which causes uneven drying.

With this point, in this exemplary embodiment, on the downstream side of the blower units 17 in the gas-flowing direction, the flow path width becomes narrower as approaching the downstream side. Thus, a flow-path cross-sectional area becomes smaller. As the flow-path cross-sectional area becomes smaller, the pressure of the gas increases. When the pressure of the gas increases, the gas flows into positions, which do not face the blower units 17. Accordingly, the flow rate can be prevented from being different among the positions in the scanning direction X in the flow path 80. Further, the second flow-through portion 86 and the blowout portion 87 are different in the direction in which the gas flows, and hence turbulence is more liable to be caused in the gas flow. The flow path width of the blowout portion 87 is set smaller than that of the second flow-through portion 86. Accordingly, the pressure of the gas is increased in the blowout portion 87 to prevent the turbulence from being caused in the gas flow.

Note that, the pressure of the gas is increased on the downstream side of the blower units 17. Accordingly, it can also be conceived that a dimension of the flow path 80 in the scanning direction X is set smaller. Even in this case, the flow-path cross-sectional area is smaller, and hence the pressure of the gas is increased. However, in this case, the dimension of the blowout port 88 in the scanning direction X may be smaller than the width of the medium M, which may cause drying insufficiency of the medium M. As in this exemplary embodiment, under a state in which the dimension of the flow path 80 in the scanning direction X is maintained, the flow path width is set smaller. In this manner, in addition to prevention of uneven drying of the medium M, drying insufficiency can be prevented.

In this exemplary embodiment, the gas blown out through the blowout port 88 is vertically blown onto the surface of the medium M. With this, as compared to the case where the gas flows in parallel to the medium M, drying efficiency of the medium M can be improved.

Further, the blowout port 88 is capable of facing the carriage 41, and hence the gas sent through the blowout port 88 also cools the carriage 41. With this, the drive circuit 15 supported by the carriage 41 can also be cooled.

Therefore, according to the exemplary embodiment described above, the following advantages can be obtained.

(1) The gas taken into the flow path 80 through the intake ports 66 is the outside air. Thus, as compared to the case where the gas is caused to circulate through the housing 18 so as to dry the medium M, humidity of the gas for drying the medium M can be prevented from increasing. Further, the flow path 80 includes the vertical portion 82 between the intake ports 66 and the blower units 17. In the vertical portion 82, the direction in which the gas flows is the direction against the gravity. In a case where the foreign matters are taken into the vertical portion 82 through the intake ports 66 together with the gas, the force toward the lower side acts on the foreign matters due to the self-weight. Thus, the foreign matters are less liable to move up the vertical portion 82, and are prevented from passing through the vertical portion 82 and flowing toward the downstream side of the flow path 80. Therefore, the foreign matters are less liable to be mixed in the gas sent through the blowout port 88, and the foreign matters can be prevented from adhering to the medium M.

(2) The vertical portion 82 has a configuration in which the gas flows upward in the vertical direction. Thus, for example, as compared to the configuration in which the gas flows obliquely upward, the foreign matters are less liable to flow to the downstream side together with the gas flow.

(3) The flow path 80 can be bent by the bent portion 83. Thus, the degree of freedom in the shape of the flow path 80 can be improved.

(4) The gas flow does not easily act on the foreign matters accumulated in the space 81. Thus, the foreign matters having fallen in the space 81 due to the self-weight can be accumulated in the space 81.

(5) By opening the cover 92, the foreign matters can be removed from the space 81 through the opening 67. Thus, the foreign matters are easily removed from the space 81.

(6) The vertical portion 82 can prevent the foreign matters from entering the storage area S1. Thus, a filter for preventing the entry of the foreign matters is not required to be provided to the flow path 80. Thus, the number of components of the printing apparatus 11 can be reduced, which leads to reduction of manufacturing cost.

Note that the above-described exemplary embodiment may be modified as the following modified examples. Any of the configurations included in the exemplary embodiment and the configurations included in the following modified examples may be freely combined, or the configurations included in the following modified examples may be freely combined to each other.

The flow-path formation portion 60 may not include the opening 67 and the opening/closing portion 91. In this case, for example, the number of years in use of the printing apparatus 11 is assumed, and then the space 81 having a size enabling the foreign matters, which are accumulated during the time period, to be stored in the space 81 may be provided.

The printing apparatus 11 may not include the space 81. In this case, the foreign matters flowing into the vertical portion 82 are, for example, returned to the outside through the intake ports 66.

The flow path 80 may not include the bent portion 83.

The flow path width of the flow path 80, which is positioned on the downstream side of the blower units 17, may be constant.

In place of the vertical portion 82 extending in the vertical direction, the upward flow path portion may be inclined to have, for example, an up-slope toward the front side as long as the flow path including a flow path portion having a direction in which the gas flows upward. Alternatively, as a part in the length direction of the flow path, the flow path may include an inverted U-shaped flow path portion with a part in which the gas flows upward. In this case, the intake ports 66 may not be positioned on the vertically lower side of the blower units 17.

The number of the blower units 17 may be single.

The printing apparatus 11 may include a filter for preventing the foreign matters from entering the storage area S1.

The two side walls 53 and 54 may not have the constant separation distance d1 between the surfaces facing each other.

The blower units 17 are only required to be arranged in the flow path 80, and may be arranged in a portion other than the first flow-through portion 84.

The liquid discharged by the printing unit 14 is not limited to ink, and may be, for example, a liquid material in which particles of a functional material are dispersed or mixed in liquid. For example, the printing unit 14 may discharge a liquid material containing a material such as an electrode material or a color material (pixel material) used in the manufacture of liquid crystal displays, electroluminescent (EL) displays, surface emitting displays, and the like in a dispersed or dissolved form.

The printing apparatus 11 may be a page printer that performs printing page-by-page.

This application claims priority under 35 U.S.C. § 119 to Japanese Patent Application No. 2018-033576, filed Feb. 27, 2018. The entire disclosure of Japanese Patent Application No. 2018-033576 is hereby incorporated herein by reference.

What is claimed is:

1. A printing apparatus comprising:

a printing unit configured to perform printing on a medium;

a flow path including a blowout port and an intake port, the blowout port being configured to send gas toward the medium from an upper side of the printing unit in a vertical direction, the intake port being configured to take in outside air;

blower units arranged in the flow path and configured to generate a gas flow passing from the intake port toward the blowout port, wherein the blower units are arranged at an interval in a direction orthogonal to the vertical direction; and a housing configured to contain the printing unit and the blower units and form the flow path, wherein the flow path includes:

an upward flow path portion between the intake port and the blower units; and a bent portion between the upward flow path portion and the blower units, wherein in the upward flow path portion, the gas that flows towards the bent portion is in a direction against the gravity.

2. The printing apparatus according to claim 1, wherein the intake port is positioned on a lower side of the blower units in the vertical direction, and the upward flow path portion extends in the vertical direction between the intake port and the blower units.

3. The printing apparatus according to claim 2, wherein the housing defines a space communicating with the bent portion, and the space is positioned on a lower side of the intake port in the vertical direction.

4. The printing apparatus according to claim 3, wherein the housing includes an opening communicating to the space, and includes a cover for covering the opening in a closable and openable manner.

5. The printing apparatus according to claim 1, wherein the housing defines a space communicating with the bent portion, and the space is positioned on a lower side of the intake port in the vertical direction.

6. The printing apparatus according to claim 5, wherein the housing includes an opening communicating to the space, and includes a cover for covering the opening in a closable and openable manner.

* * * * *